US009849324B2

(12) United States Patent
Howell

(10) Patent No.: US 9,849,324 B2
(45) Date of Patent: Dec. 26, 2017

(54) WAKEBOARD TRAINING TRAMPOLINE APPARATUS

(76) Inventor: Phillip Howell, Carrollton, TX (US)

( * ) Notice: Subject to any disclaimer, the term of this patent is extended or adjusted under 35 U.S.C. 154(b) by 0 days.

(21) Appl. No.: 13/506,060

(22) Filed: Mar. 23, 2012

(65) Prior Publication Data

US 2013/0252787 A1 Sep. 26, 2013

(51) Int. Cl.

| | |
|---|---|
| ***A63B 5/11*** | (2006.01) |
| *A63B 69/18* | (2006.01) |
| *A63B 71/00* | (2006.01) |

(52) U.S. Cl.

CPC ..... *A63B 5/11* (2013.01); *A63B 69/187* (2013.01); *A63B 71/0054* (2013.01)

(58) Field of Classification Search

CPC ..... A63B 5/11
USPC ..... 482/33, 27–29
See application file for complete search history.

(56) References Cited

U.S. PATENT DOCUMENTS

| | | | | |
|---|---|---|---|---|
| 1,104,505 | A * | 7/1914 | Holworthy | A63B 7/02 482/24 |
| 3,201,126 | A * | 8/1965 | Nissen | 273/393 |
| 3,339,925 | A * | 9/1967 | Nissen | 473/469 |
| 3,501,141 | A * | 3/1970 | Nissen | A63B 5/11 482/29 |
| 4,824,100 | A * | 4/1989 | Hall | A63B 5/11 482/28 |
| 5,577,984 | A * | 11/1996 | Bare, II | 482/43 |
| 5,624,122 | A * | 4/1997 | Winkelhorn | 473/471 |
| 5,788,606 | A * | 8/1998 | Rich | 482/27 |
| 6,652,419 | B1 * | 11/2003 | Rota | A63B 1/00 482/27 |
| 7,182,695 | B1 * | 2/2007 | Tostenson et al. | 472/50 |
| 2006/0223676 | A1 * | 10/2006 | Rote | A63B 5/11 482/27 |
| 2007/0010374 | A1 * | 1/2007 | Widich | 482/27 |
| 2007/0135282 | A1 * | 6/2007 | Coraggio et al. | 482/142 |
| 2010/0190608 | A1 * | 7/2010 | Publicover et al. | 482/8 |
| 2011/0053713 | A1 * | 3/2011 | Bulloch | 473/435 |
| 2013/0310223 | A1 * | 11/2013 | Canales et al. | 482/27 |
| 2014/0005003 | A1 * | 1/2014 | Howell | 482/27 |

* cited by examiner

*Primary Examiner* — Loan H Thanh
*Assistant Examiner* — Megan Anderson
(74) *Attorney, Agent, or Firm* — Baumli Law Firm PLLC; Adam Baumli

(57) ABSTRACT

The invention is a wakeboard training device utilizing a trampoline for the jumping surface and a tow rope structure for the control for the rider. The jumping surface can be inclined to improve simulating wave support and the trampoline improves safety and training efficiency. A training park would include connecting four of these devices together to form a quadrangle shape to maximize room efficiency so that multiple riders can train safely in a room. It would also allow one rider to perform 360 degree tricks about the pivot center of the device.

5 Claims, 3 Drawing Sheets

WAKEBOARD TRAINING TRAMPOLINE APPARATUS

FIELD OF INVENTION

The present invention relates generally to trampolines, and more specifically to trampolines and wakeboards.

PROBLEM STATEMENT

Interpretation Considerations

This section describes the technical field in more detail, and discusses problems encountered in the technical field. This section does not describe prior art as defined for purposes of anticipation or obviousness under 35 U.S.C. section 102 or 35 U.S.C. section 103. Thus, nothing stated in the Problem Statement is to be construed as prior art.

Discussion

The popularity of wakeboard competitions have drastically increased over the recent years and those competitions are highly competitive with large financial incentives. Some of the best wakeboarders receive large financial sponsorships as a result of great performances. Due to the increase of interest and financial considerations, training for wakeboarding has increased as well. The best wakeboarders in the world spend hours per day honing their tricks and their craft. The evolution of the sport has led to some incredible tricks such as the "1260 and the triple front flip."

Currently, the only way to train is to take a boat out on a lake and try new tricks. This requires more than 1 person to practice, is timely inefficient, and can be very dangerous to attempt new tricks. Generally, training requires 3 people, the wakeboarder, the person driving the boat, and a spotter in the boat to let the driver know when the wakeboarder has fallen. Practicing wastes a large amount of time. It takes time to get the boat ready, get on the lake, and set up to train. If the wakeboarder falls, it takes time to circle the boat back around and start over. Lastly, it is dangerous.

Training on the water is dangerous. When falling after attempting a trick, the body absorbs contact falling a great distance and at a high velocity. Injuries are very common when attempting new tricks. Accordingly, there is a need for a wakeboard training device to reduce the amount of downtime between tricks and reduce the danger associated.

BRIEF DESCRIPTION OF THE DRAWINGS

Various aspects of the invention, as well as an embodiment, are better understood by reference to the following detailed description. To better understand the invention, the detailed description should be read in conjunction with the drawings and tables, in which.

EXEMPLARY EMBODIMENT OF A BEST MODE

Interpretation Considerations

Figure 1:
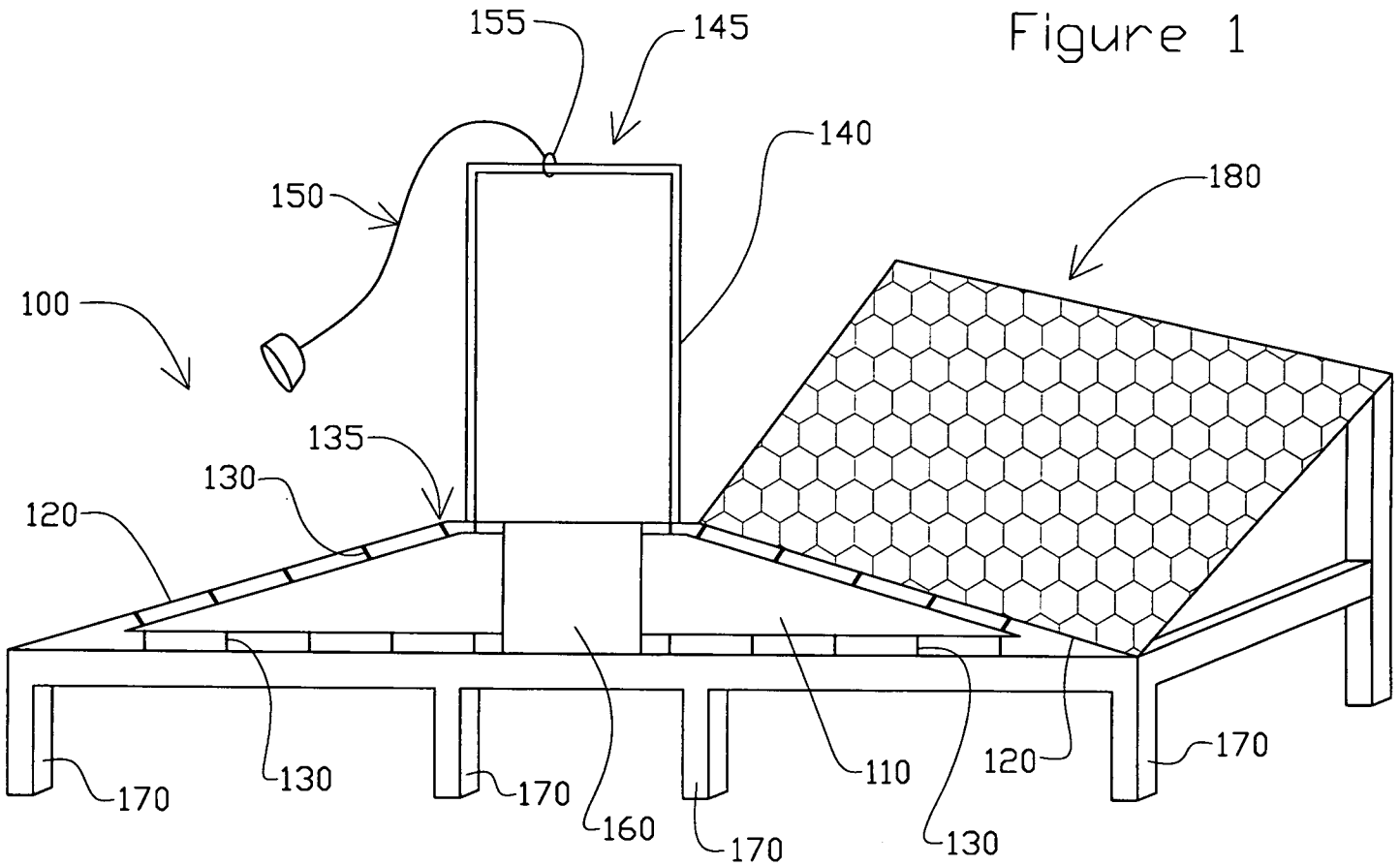
FIG. 1 shows an isometric side view of the wakeboard training device.

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "tacking" may be done by nailing, stapling, gluing, hot gunning, riveting, etc., and so a use of the word tacking invokes stapling, gluing, etc., and all other modes of that word and similar words, such as "attaching").

Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in §112, paragraph 6 of 35 U.S.C., unless used as "means for—functioning—" or "step for—functioning—" in the Claims section. Sixth, the invention is also described in view of the Festo decisions, and, in that regard, the claims and the invention incorporate equivalents known, unknown, foreseeable, and unforeseeable. Seventh, the language and each word used in the invention should be given the ordinary interpretation of the language and the word, unless indicated otherwise.

It should be noted in the following discussion that acts with like names are performed in like manners, unless otherwise stated. Of course, the foregoing discussions and definitions are provided for clarification purposes and are not limiting. Words and phrases are to be given their ordinary plain meaning unless indicated otherwise.

Description of the Drawings

Wakeboards are boards used for riding the wake wave created behind a boat and the rider while holding a tow rope attached to the boat can ride along at a high rate of speed.

The tow rope allows the rider to perform jumps and complex tricks off of the wake. This apparatus and method is for training a wakeboard rider without the need of the boat.

Shown in FIG. 1 is the basic wakeboard training device 100. The wakeboard training device 100 has a plane which is a platform with a jumping surface 110 which is a jumping material. The jumping material can be a polypropylene similar to what is commonly used for trampolines. The jumping surface 110 is coupled to the device frame 120 via at least 1 elastic coupler 130. The device frame 120 is a rigid material such as steel. The frame 120 can be hollow, solid, round, and/or square. Shown is a plurality of elastic couplers 130. The elastic couplers 130 can be a coil spring, but other elastic alternatives are acceptable. The frame 120 can include a bar connector 135 which is affixed to the frame 120 and couples one side of the coil spring 130. The bar connector 135 secures the coil spring 130 more effectively than connecting said spring 130 to frame 120 directly.

Connected to the front of the frame is a tow rope support structure 140. The tow rope support structure is a rigid structure used to secure the tow rope 150. The tow rope 150 is secured to the tow rope support structure via a coupler 155. The coupler 155 can range from many options, shown is the ring which encompasses the top beam 145 of the tow rope support structure 140. The ring allows the tow rope 150 to slide about the top beam 145 from one side to the other in order to maximize range of the tow rope 150. Another embodiment would have the tow rope 150 affixed to the center of the top beam 145 to limit range of the tow rope 150; the coupler would be a pin, a screw, glue, or even tying the tow rope 150 in replace of the coupler.

Shown in Figure one is a center platform 160. The center platform 160 is not necessary for the apparatus. The wakeboard rider can start on the platform 160 to start a practice routine. The platform can be a solid material such as steel, wood, or plastic. The platform 160 can also be a soft material such as padding. The padding works as a soft point for the wakeboard rider to resituate himself during a practice routine.

The wakeboard training device 100 can have additional improvements to add structure and safety. The wakeboard training device 100 can be raised via a plurality of supports 170. The supports 170 raise the wakeboard training device 100 so that when the jumping surface 110 sinks due to the rider landing on it 100, then the jumping surface 110 does not impact the ground. Raising the structure of the wakeboard training device 100 increases safety of the riders. Impacting the ground when landing jumps and/or tricks can lead to injuries.

The wakeboard training device 100 can have safety pads (shown in a later figure) that cover the springs 130. The pads would cover the rigid frame 120 and the springs 130 up to the jumping surface 110. The pads protect the rider in case of impact with the frame and/or the springs. In addition, a safety net 180 has been added to the wakeboard training device 100. The safety net 180 is a protection system in case the rider loses a handle on the tow rope 150 and flies uncontrollably off the side of the wakeboard training device 100. The safety 180 net is not needed, but is an additional safety feature shown. The safety net 180 can encompass the outer zone of the wakeboard training device 100 including all sides.

Figure 2:
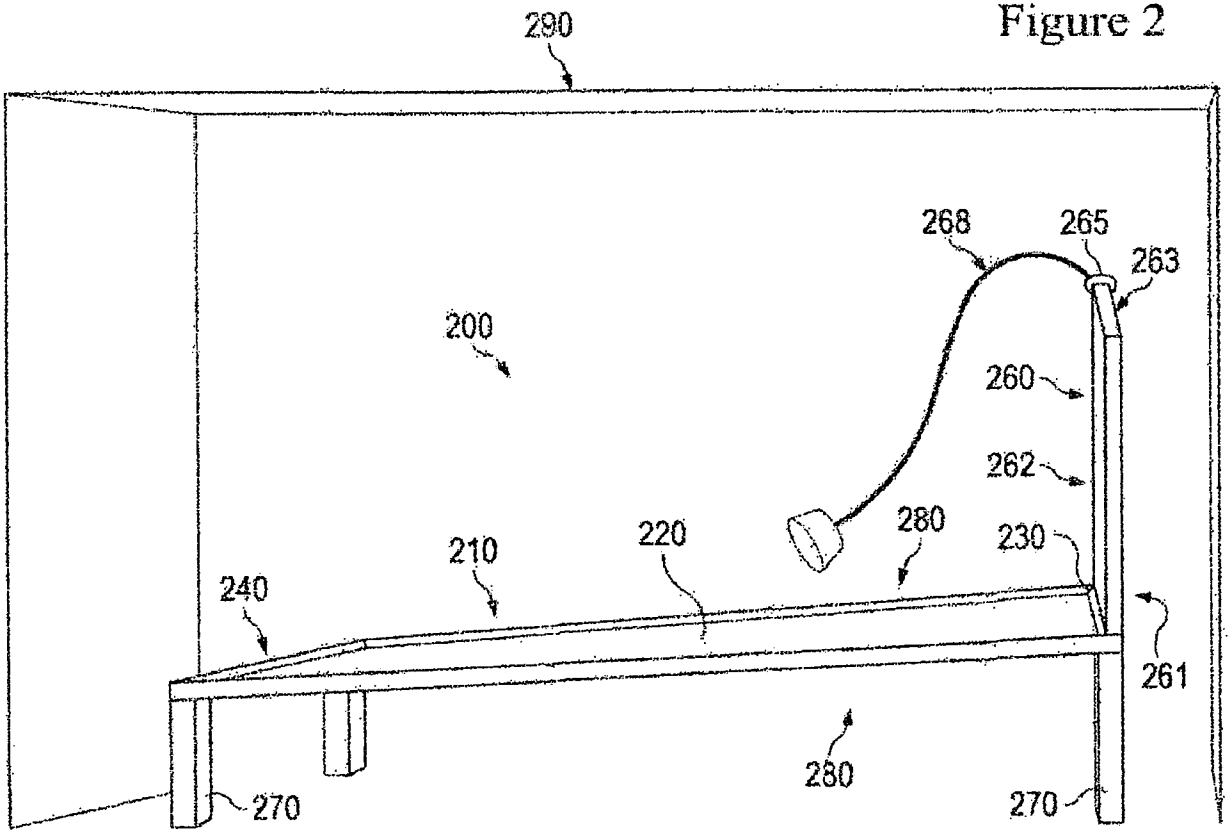
FIG. 2 shows an isometric front view of the wakeboard training device.

Shown in FIG. 2 is the side view of the wakeboard training device 200. The wakeboard training device has a frame 210 which is made of four sides to encompass a quadrilateral area covered by the material that is the jumping surface 220. The safety pads 280 that were discussed earlier are shown in FIG. 2. These pads 280 cover the frame 210 and the coil springs (shown in FIG. 1) in order to reduce risk of injury. There is a slight opening area about the springs shown in FIG. 1 that is now covered in FIG. 2 by the pads 280 so that a rider's limb cannot slip between the springs.

The frame 210 is situated at an incline. The front 230 is raised higher than the rear 240 of the frame 210. The incline increases pressure on jumps to force the rider backwards and up when jumping which in turn increases tightness in the tow rope simulating a jump on a wakeboard in water where the velocity of the boat increases tightness on the tow rope following the take-off of a jump.

The frame is raised by a plurality of supports 270 in order to allow the trampoline jumping surface and springs to elastically expand below the frame 210 when a jumper lands and avoiding impact with the ground. The elasticity of the jumping surface 220 absorbs the force of landing a jump and forces a recoil sending the rider and wakeboard flying into the air.

The tow rope support structure 260 is secured to the front 230 of the frame 210. In FIG. 2, the tow rope support structure is made of 2 upright bars, a first upright bar 261 and a second upright bar 262, and a horizontal bar 263 which connects the top ends of the upright bars 261, 262. A coupler ring 265 is encompassing the horizontal bar 263 allowing more lateral range for the rider as the ring 265 can slide from one end of the upright bar 265 to the other. A tow rope 268 is affixed to the ring 265.

An additional wall platform is shown 290 which allows the rider to use to add more height and difficulty to tricks. The rider can jump from the top of the platform to increase height on following jumps which allows for more difficult tricks such as 720s or triple front spins. The wall 290 also acts as a side barrier for the rider to jump into to create more unique tricks such as jumping into the wall 290 and spinning off of it 290. This additional feature adds more variety to the uses of the wakeboard trampoline training device 200.

Figure 3:
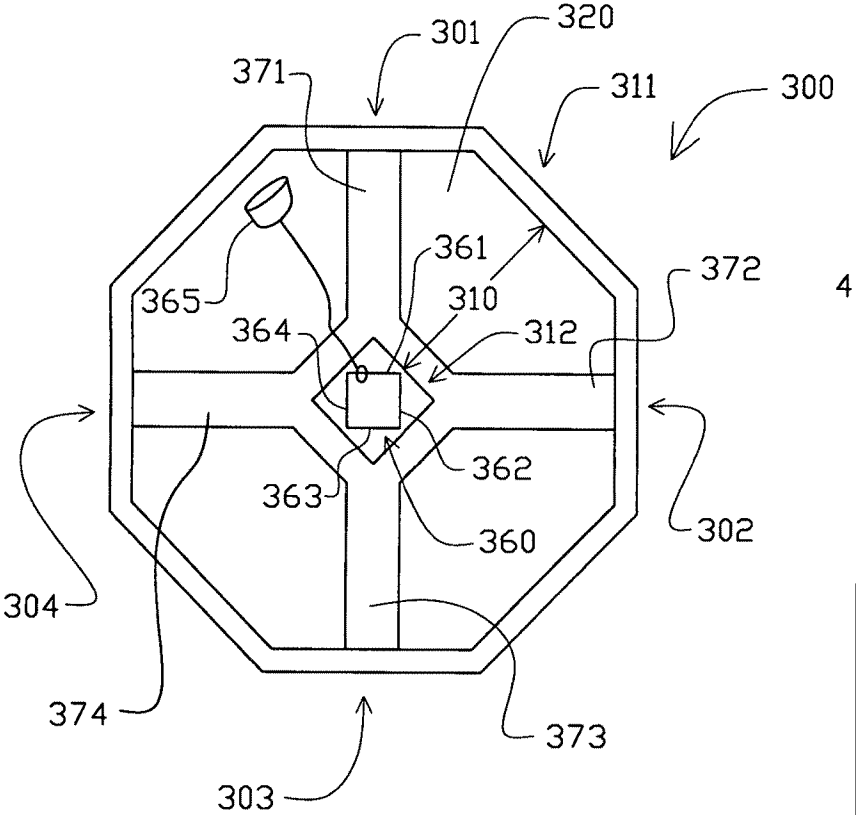
FIG. 3 shows an isometric rear view of the wakeboard training device.

FIG. 3 is the wakeboard trampoline training park 300 which has a plurality of wakeboard trampoline training devices 301, 302, 303, 304. The four wakeboard trampoline training devices 301, 302, 303, 304, are affixed together to form a roundish or square shape. The frame 310 has an outer frame 311 and an inner frame 312. The inner frame can be at a higher elevation than the outer frame creating the incline discussed in FIG. 2. There is one jumping surface 320 that covers all four of the training devices 301, 302, 303, 304. The jumping surface 320 covers the opening between the inner frame 312 and the other frame 311. Shown in FIG. 3 is a square shaped inner frame 312 and an octagon shaped outer frame 311, but a circular shaped frame or square shaped frame would work for both. The jumping surface is a material and is coupled to the frame 310 by elastic components (not shown, but shown in FIG. 1).

The tow rope support 360 structure is more developed to assist a plurality of wakeboard riders as opposed to just a single one. The tow rope support structure 360 has an upper bar 361, 362, 363, 364 for each side for each rider. The upper bars 361-364 are connected to upright bars which aren't shown in this figure but shown in previous figures and understood by those with ordinary skill in the art. The tow rope support structure 360 can be multiple shapes, for example, the tow rope support structure 360 can be a round circular shaped bar or a single pivot point. These additional structures allow a rider to swing 360 degrees around the apparatus for unique tricks. Affixed to the tow rope support structure is at least one tow rope 365 to perform all of these tricks and give the rider control.

Each training apparatus section has a starting pad 371, 372, 373, & 374. The training pads 371-374 are rectangular pads for the wakeboard rider to start on. These pads can be rigid material such as a wood or polymer or a nylon pad filled with a tempurpedic composite or a similar composite to absorb impact force. These pads 371-374 are not required, but are an additional feature to separate each individual training device. The wakeboard training park 300 has pads covering the springs and the frame 311, 312 sections of the apparatus 300. These pads were discussed in FIG. 2 and add safety to the apparatus 300.

Figure 4:
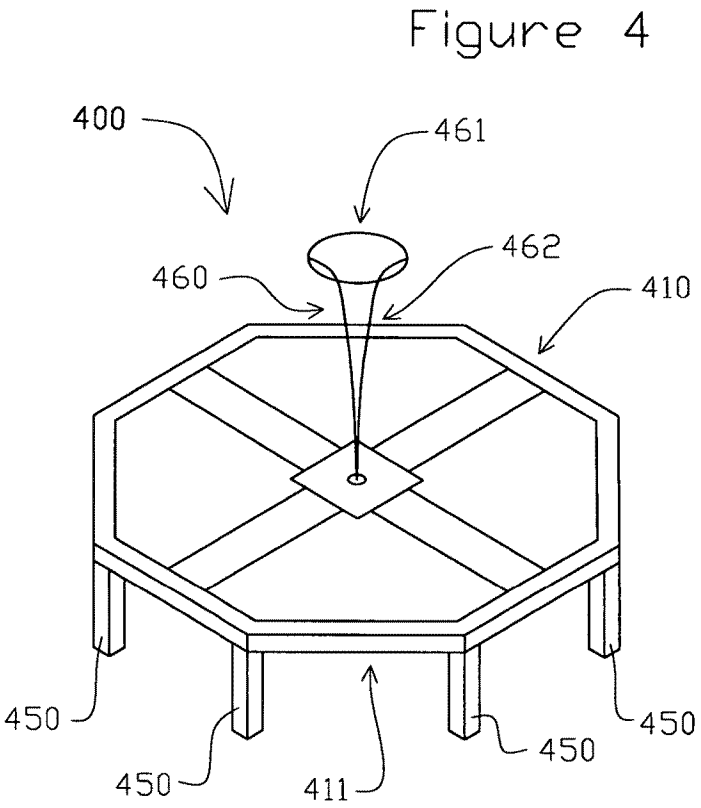
FIG. 4 shows an isometric view of a plurality of wakeboard training devices interconnected.

Shown in FIG. 4 is an isometric view of the wakeboard training trampoline park 400. The wakeboard trampoline training park 400 has a plurality of supports 450. The frame 410 in this embodiment has the same two sections, an outer frame 411 and an inner frame (not shown in this figure). The addition to this embodiment is the tow rope support structure 460 has a circular ring 461 attached to the top of one upright bar 462. The circular ring was discussed in FIG. 3 allowing the rider to perform 360 degree tricks.

The wakeboard trampoline device is used for a method of training wakeboard riders to perform tricks safely using a trampoline instead of water. The wakeboard rider uses a tow rope to secure to a tow rope support structure to create tension and control. The wake board rider jumps on the trampoline to create lift force caused by the recoil of the trampoline. The wakeboard rider can then perform tricks similarly to the ones performed while riding a wakeboard on a lake being pulled by a boat or jet-ski. Using the incline where the front of the trampoline is more elevated than the rear, the wakeboard rider can simulate the force of being lifted up and being pulled forward similarly to training behind a boat on a lake. The incline forces the wakeboard rider up and to the rear creating additional tension on the tow rope, similarly to training on a lake.

In concluding the detailed description, it should be noted that it will be obvious to those skilled in the art that many variations and modifications may be made to the preferred embodiment without substantially departing from the principles of the present invention. All such variations and modifications are intended to be included herein within the scope of the present invention, as set forth in the following claims.

I claim:

1. A wakeboard trampoline training apparatus comprising:

a singular plane comprising a frame connecting a front side, a first side, a rear side, and a second side to encompass an area, the front side being higher than the rear side, wherein the frame is at a straight incline so that the front side of the frame is at a higher elevation than the rear side;

a piece of material substantially covering the plane wherein the material is affixed to the frame via elastic couplers;

a tow rope support structure comprised of at least a first upright bar affixed to the front side the frame; and a tow rope coupled to the tow rope support structure, the tow rope is adapted for a user's grip to hold or freely release;

wherein the tow rope support structure allows the freedom for the tow rope to swing side to side allowing the rider to move side to on the apparatus.

2. The apparatus in claim 1 wherein the tow rope support structure further comprises:

that the first upright bar coupled to the front side of the frame proximate to the right side of said front side of the frame, the first upright bar having a top end;

a second upright bar coupled to the front side of the frame proximate to the left side of the front side the frame, the second upright bar having a top end;

a top bar coupling the top ends of the first upright bar and the second upright bar.

3. The apparatus in claim 2 wherein there is a ring about the top bar to couple the tow rope with the top bar, allowing the ring to slide from side to side on the top bar.

4. The apparatus claim 1 wherein there is a safety platform. coupled to the piece of material and the front side of the frame and the rear side the frame.

5. The apparatus in claim 1 wherein safety pads are secured to the front side, the first side, the rear side, and the second side of the frame, wherein the safety pad covers the frame and the elastic couplers that connect the piece of material to the frame.

* * * * *